US006734638B2

(12) United States Patent
Kang et al.

(10) Patent No.: US 6,734,638 B2
(45) Date of Patent: May 11, 2004

(54) ELECTRODELESS LIGHTING SYSTEM

(75) Inventors: Hyung Joo Kang, Gwangmyeong (KR); Joon Sik Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/098,346

(22) Filed: Mar. 18, 2002

(65) Prior Publication Data

US 2003/0057840 A1 Mar. 27, 2003

(30) Foreign Application Priority Data

Sep. 27, 2001 (KR) ..... 2001-60194

(51) Int. Cl.[7] ..... H05B 41/16
(52) U.S. Cl. ..... 315/248; 315/39
(58) Field of Search ..... 315/246, 248, 315/39, 344, 267; 362/296, 297

(56) References Cited

U.S. PATENT DOCUMENTS 5,227,698 A * 7/1993 Simpson et al. ..... 315/248
5,334,913 A * 8/1994 Ury et al. ..... 315/248
5,811,936 A * 9/1998 Turner et al. ..... 315/39
5,841,233 A * 11/1998 Ury et al. ..... 315/39
5,905,342 A * 5/1999 Mimasu et al. ..... 315/39
6,046,545 A * 4/2000 Horiuchi et al. ..... 315/39
6,465,959 B1 * 10/2002 Tian et al. ..... 315/39
2002/0030453 A1 * 3/2002 Kirkpatrick et al. ..... 315/248

* cited by examiner

*Primary Examiner*—James Clinger
*Assistant Examiner*—Ephrem Alemu
(74) *Attorney, Agent, or Firm*—Birch, Stewart Kolasch & Birch, LLP

(57) ABSTRACT

An electrodeless lighting system comprising: a case; a waveguide, in which an exit is exposed out of the case, installed in the case for transmitting the microwave generated in a magnetron; a bulb located outside of the exit of the waveguide and emitting light as generating plasma by the microwave transmitted through the waveguide; a protecting member fixed on the exit of the waveguide around a boundary portion of the bulb for making a resonating area in which the microwave is resonated, and formed to endure the heat generated from the bulb; and a resonator connected to the protecting member on front side of the bulb and having a reticular portion so as to prevent the leakage of the microwave and pass the light generated from the bulb, and thereby, discoloring or burning of a mesh portion of the resonator by the high temperature generated from the bulb can be prevented and therefore the leakage of the microwave in the resonating area, accordingly stability of the lighting system can be improved and life span of the resonator can be increased.

15 Claims, 5 Drawing Sheets

ELECTRODELESS LIGHTING SYSTEM

BACKGROUND OF THE INVENTION

1. Field of the Invention

The present invention relates to an electrodeless lighting system, and particularly, to an electrodeless lighting system by which damages of a resonator by being burnt or discolored by high temperature generated from a bulb.

2. Description of the Background Art

Generally, an electrodeless lighting system is a lighting system in which microwave generated in a magnetron is transmitted to a resonator through a waveguide, and the microwave is applied to an electrodeless bulb installed inside the resonator so that the bulb emits visible rays or ultraviolet rays. Therefore, the electrodeless lighting system has longer life span than that of incandescent lamp or fluorescent lamp which is generally used, and has higher lighting effect.

FIG. 1 is a longitudinal cross-sectional view showing an electrodeless lighting system according to the conventional art.

As shown therein, the electrodeless lighting system comprises: a case 1, a cooling device 13 for cooling down inner part of the case 1, a magnetron 3 generating microwave, a bulb 6 for emitting light as generating plasma by the microwave generated in the magnetron 3, a resonator 8 installed around the bulb 6 for blocking the microwave and passing the light, and a reflector 9 fixed on outer side of the case 1 so that the light passed through the resonator 8 can be reflected.

The case 1 includes a plurality of discharge holes 1*b* so that air flowed by the cooling device 13 can be discharged to outside after cooling down the components in the case 1.

The cooling device 13 comprises a fan housing 12 having a suction hole 12*b* and an exhaust hole 12*a* so as to suck outer air and installed on rear side of the case 1, a cooling fan 11 installed inside the fan housing 12 for sucking the outer air, and a fan motor 10 rotating the cooling fan 11.

The magnetron 3 generates the microwave by being applied high voltage from a high voltage generator 2 which provides high voltage after transforming utility AC power to the high voltage, and the generated microwave is transmitted to the bulb 6 through a waveguide 4.

The bulb 6 is protruded to upper outer side through an opening portion 1*a* formed on the case 1, and is formed to be rotated by operation of a bulb motor 7 by connecting to a rotation shaft 5 so as to be cooled down during emitting light.

The resonator 8 is assembled on an outer portion of the protruded part of the waveguide 4, and it is formed as a net having a mesh of predetermined size so that the leakage of the microwave is blocked and the light emitted from the bulb 6 can be passed.

And the reflector 9 is assembled to wrap the resonator 8 around the resonator 8 so as to reflect the light which is emitted from the bulb 6 and passed through the resonator 8.

Operation of the conventional electrodeless lighting system constructed as above will be described as follows.

First, when the electric power is applied, the high voltage is generated by transforming the AC power in the high voltage generator 2, and the generated high voltage is transmitted to the magnetron 3. In addition, the magnetron 3 generates the microwave having high frequency as oscillated by the applied high voltage.

The microwave generated as above is radiated into the resonator 8 through the waveguide 4, and material filled in the bulb 6 is discharged by the radiated microwave to emit the light by the plasma. In addition, the emitted light is reflected on the reflector 9, and therefore, radiated to the frontward.

In addition, when the light is emitted from the bulb 6, the bulb motor 7 is operated to rotate the rotation shaft 5, and therefore, the bulb 6 is rotated to be cooled down so as not to be heated more than a predetermined temperature.

Also, the fan motor 10 installed inside the case 1 is operated, and accordingly the cooling fan 11 is rotated, and the outer air which is sucked through the suction hole 12*b* flows to the exhaust hole 12*a* by the rotation of the cooling fan 11. In addition, the outer air cools down the high voltage generator 2 and the magnetron 3, after that, is discharged out of the case 1 through the plurality of discharged holes 1*b* formed on an upper surface of the case 1.

However, according to the electrodeless lighting system of the conventional art, the net portion of the resonator which is located near the bulb may be discolored or burnt by the high temperature generated from the bulb after a certain time period is passed, and the burnt part may be damaged when a long period is passed, and thereby, the microwave may be leaked and the resonator can not be used.

SUMMARY OF THE INVENTION

Therefore, an object of the present invention is to provide an electrodeless lighting system by which damage of a resonator by high temperature generated when a bulb emits can be prevented, and therefore, microwave is not leaked and a life span of the resonator is increased.

To achieve the object of the present invention, as embodied and broadly described herein, there is provided an electrodeless lighting system comprising: a case; a waveguide installed in the case so that an exit of the waveguide is exposed to outer part of the case for transmitting the microwave generated in a magnetron; a bulb located out of the exit of the waveguide for emitting light as plasma is generated by the microwave transmitted through the waveguide; a protecting member fixed on the exit of the waveguide around a boundary part of the bulb to form a resonating space in which the microwave is resonated, and formed with a material, which can block the microwave and the light emitted from the bulb and can endure the heat generated from the bulb; and a resonator connected to the protecting member on a front part of the bulb and having a reticular portion so as to block the leakage of the microwave and pass the light emitted from the bulb.

Also, the resonator of the electrodeless lighting system according to the present invention comprises a protecting portion of non-reticular structure which is fixed on the exit of the waveguide around the boundary portion of the bulb for making a resonating area in which the microwave is resonated, and a reticular portion connected to the protecting portion as a single body on front side of the bulb for blocking the leakage of the microwave and for passing the light emitted from the bulb.

Also, the resonator of the electrodeless lighting system according to the present invention comprises a reticular portion located on the front side of the bulb for blocking the leakage of the microwave and passing the light emitted from the bulb, and a fixed portion fixed on the boundary portion of the reticular portion as a ring shape.

Also, the reflector of the electrodeless lighting system according to the present invention comprises: a fixed portion fixed on the case around the exit of the waveguide; a protecting portion of non-reticular structure extended from the fixed portion to the boundary portion of the bulb as a cylindrical form for making a resonating area in which the microwave is resonated; a reflection portion for reflecting the light emitted from the bulb as expanded from the protecting portion to frontward gradually.

According to the electrodeless lighting system of the present invention, the material filled in the bulb is discharged by the microwave generated in the magnetron, and then the plasma is generated by the heat, and therefore, the light is emitted as maintaining the discharged state by the microwave. At that time, the heat of high temperature generated from the bulb is blocked by the protecting portion located around the bulb not to damage the resonator, and thereby the stability can be ensured by blocking the leakage of the microwave and the life span of the resonator can be increased.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
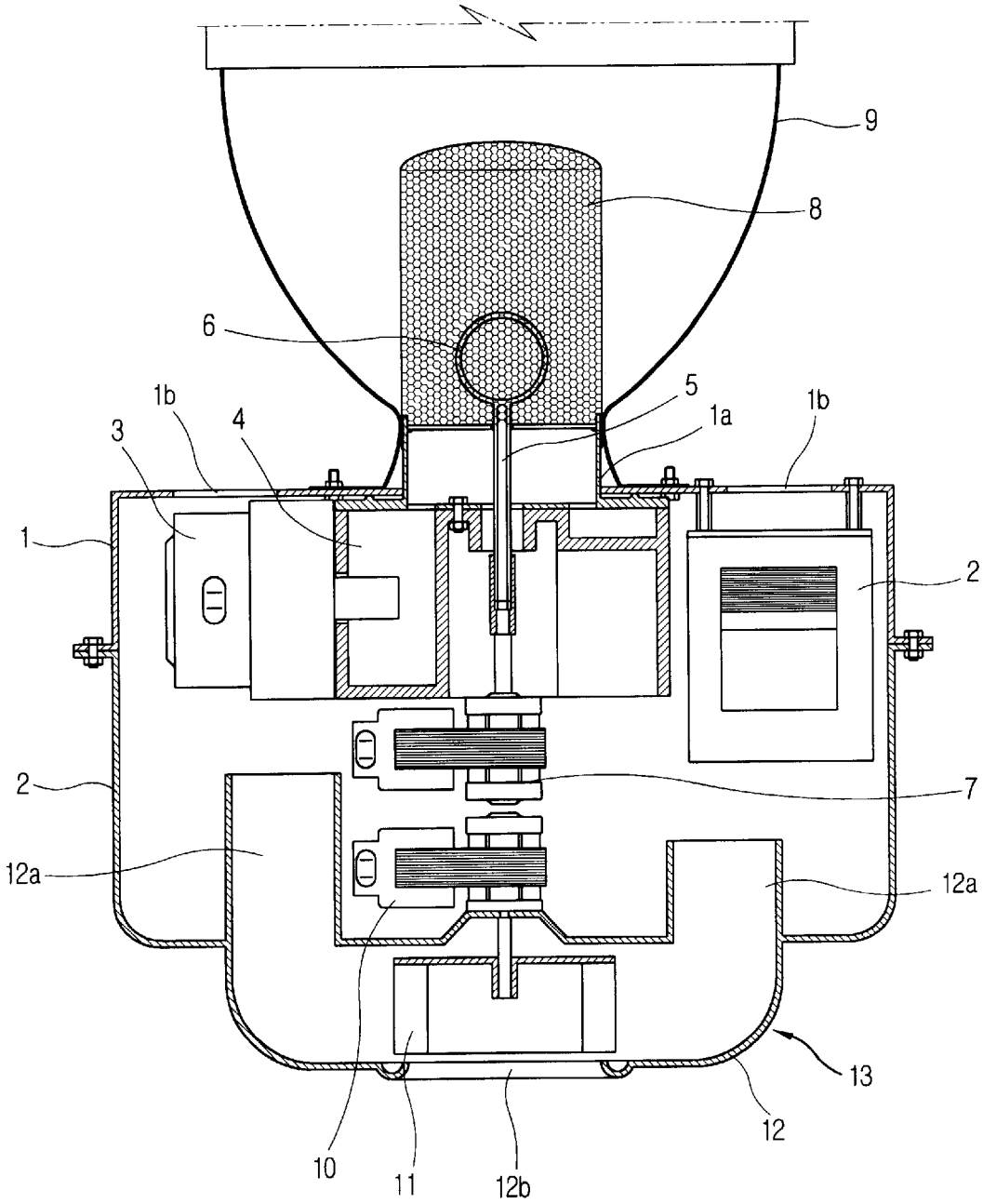
FIG. 1 CONVENTIONAL ART
FIG. 1 is a longitudinal cross-sectional view showing an electrodeless lighting system according to the conventional art.
Figure 2:
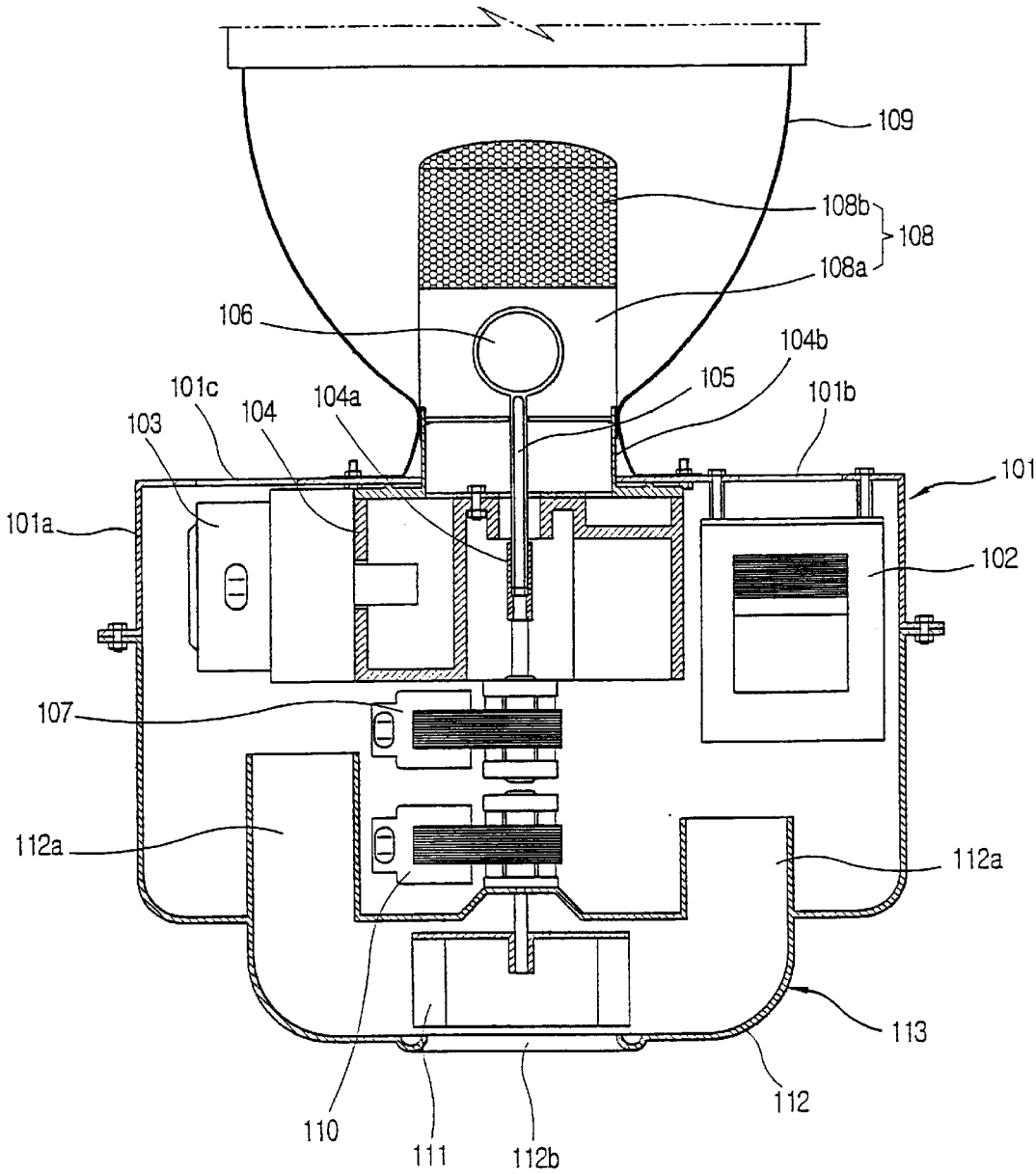
FIG. 2 is a block diagram showing an electrodeless lighting system according to an embodiment of the present invention.
Figure 3:
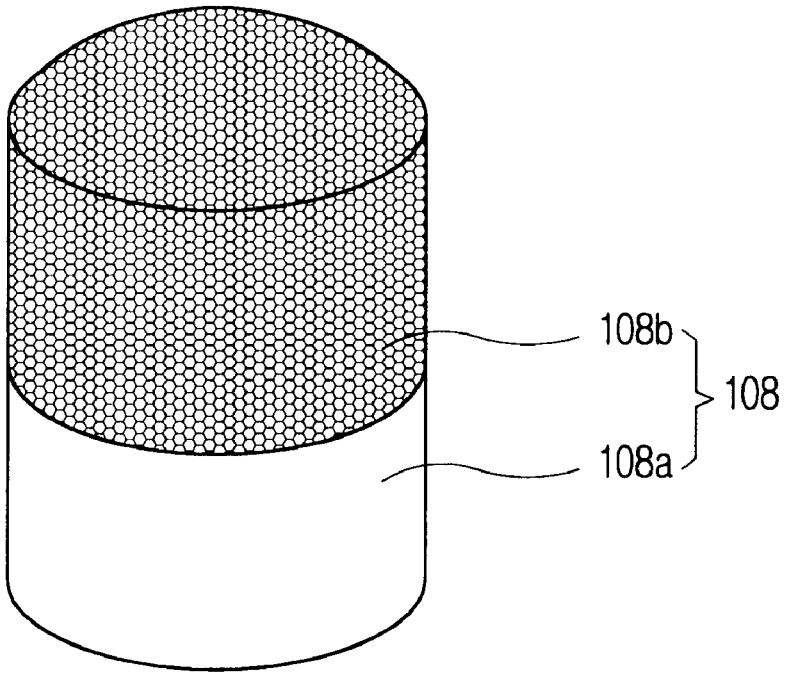
FIG. 3 is a perspective view showing a resonator according to the present invention.

FIG. 2 is a longitudinal cross-sectional view showing an electrodeless lighting system according to an embodiment of the present invention, and FIG. 3 is a perspective view showing a resonator shown in FIG. 2.

As shown therein, the electrodeless lighting system according to the present invention comprises: a case 101; a cooling device 113 for cooling down inside of the case 101; a magnetron 103 for generating microwave; a waveguide 104 for transmitting the microwave generated in the magnetron 103; a bulb 106 located on outer part of an exit 104*b* of the waveguide 104 and emitting light as generating plasma by the microwave; a resonator 108 fixed on the exit 104*b* of the waveguide 104 around the bulb 106 for blocking leakage of the microwave and for passing the light emitted from the bulb 106; and a reflector 109 fixed on the case 101 so as to reflect the light which passes through the resonator 108.

The case 101 is constructed by coupling a front case 101*a* and a rear case 101*b*, and the front case 101*a* includes a plurality of discharge holes 101*c* so that air can be discharged to outside after cooling down the components in the case 101 by the cooling device 113.

The cooling device 113 comprises a fan housing 112 installed on rear side of the case 101 and including a suction hole 112*b* and an exhaust hole 112*a* so as to suck the outer air, a cooling fan 111 installed inside the fan housing 112 for sucking the outer air, and a fan motor 110 for rotating the cooling fan 111.

The magnetron 103 generates microwave by being applied high voltage from the high voltage generator 102 which transforms utility AC power into high voltage and provides the high voltage, and the generated microwave is transmitted to the bulb 106 through the waveguide 104.

The bulb 106 is located on outer side of the front case 101*a*, and it is coupled to a rotation shaft 105 which is rotated by an operation of a bulb motor 107 to cool down the bulb 106 of high temperature during emitting the light.

The rotation shaft 105 rotates the bulb 106 by the operation of the bulb motor 107 through a shaft hole 104*a* formed on an intermediate part of the waveguide 104.

The resonator 108 comprises a protecting portion 108*a* of non-reticular structure fixed on the exit 104*b* of the waveguide 104 for enduring the heat generated from the bulb 106 and for making a resonating area in which the microwave is resonated, and a reticular portion 108*b* connected to the protecting portion 108*a* from the front side of the bulb 106 for blocking the leakage of the microwave and for passing the light generated from the bulb 106.

Herein, the resonator 108 is formed as a cylinder in which the part fixed on the exit 104*b* of the waveguide 104 is opened, and the protecting portion 108*a* and the reticular portion 108*b* are formed as a single body with each other.

Also, the protecting portion 108*a* is formed with a material which can block the microwave and the light emitted from the bulb 106.

The reflector 109 is installed on the front case 101*a* in order to reflect the light which is emitted from the bulb 106 and passed through the resonator 108 to frontward.

The bulb 106 does not include an electrode or a filament therein, has longer or semipermanent life span. The material which is filled in the bulb 106 may be metal, halogen compounds, or sulfur and selenium which emits by forming plasma when the microwave is applied to the bulb 106, inert gas such as argon, xenon, kripton for forming plasma inside the bulb 106 at an initial stage of emitting light, and additives for making the lighting to be easy by helping the initial discharge or for controlling spectrum of the emitted light. In addition, the kinds, amount, or ratio of these materials are controlled according to the object of the illuminant.

An operation of the electrodeless lighting system according to the present invention constructed above will be described as follows.

When the high voltage is generated in the high voltage generator 102 after the electric power is applied, the high voltage is transmitted to the magnetron 103 to generate the microwave in the magnetron 103.

In addition, the generated microwave is radiated to inside of the resonator 108 through the waveguide 104, and the material filled in the bulb 106 is discharged by the radiated microwave and the light is emitted by the plasma. And the emitted light passes through the reticular portion 108*b* of the resonator 108 and radiated to frontward, or reflected by the reflector 109 and radiated to frontward.

Also, high temperature is generated around the emitting bulb 106, and therefore the protecting portion 108*a* made with heat-resistant material is formed around the bulb 106 so as to prevent the discoloring or burning of the resonator 108 by the high temperature, and thereby the damage of the resonator 108 by the high temperature generated from the bulb 106 can be prevented.

On the other hand, when the light is emitted from the bulb 106, the bulb motor 107 rotates at a predetermined speed to rotate the rotation shaft 105, and therefore the bulb 106 fixed on one end part of the rotation shaft 105 is rotated. Therefore, overheating and damage on a part on the surface of the bulb 106 by an affection of electronic/magnetic field in the resonator 108 can be prevented by the rotation of the bulb 106.

In addition, the fan motor 110 installed in the case 101 rotates to rotate the cooling fan 111, and the outer air sucked through the suction hole 112*b* by the rotation of the cooling fan 111 flows through the exhaust hole 112*a* to cool down the inner components in the case 101, after that, the sucked air is discharged out of the case 101 through the discharge hole 101*c* formed on upper surface of the case 101.

Figure 4:
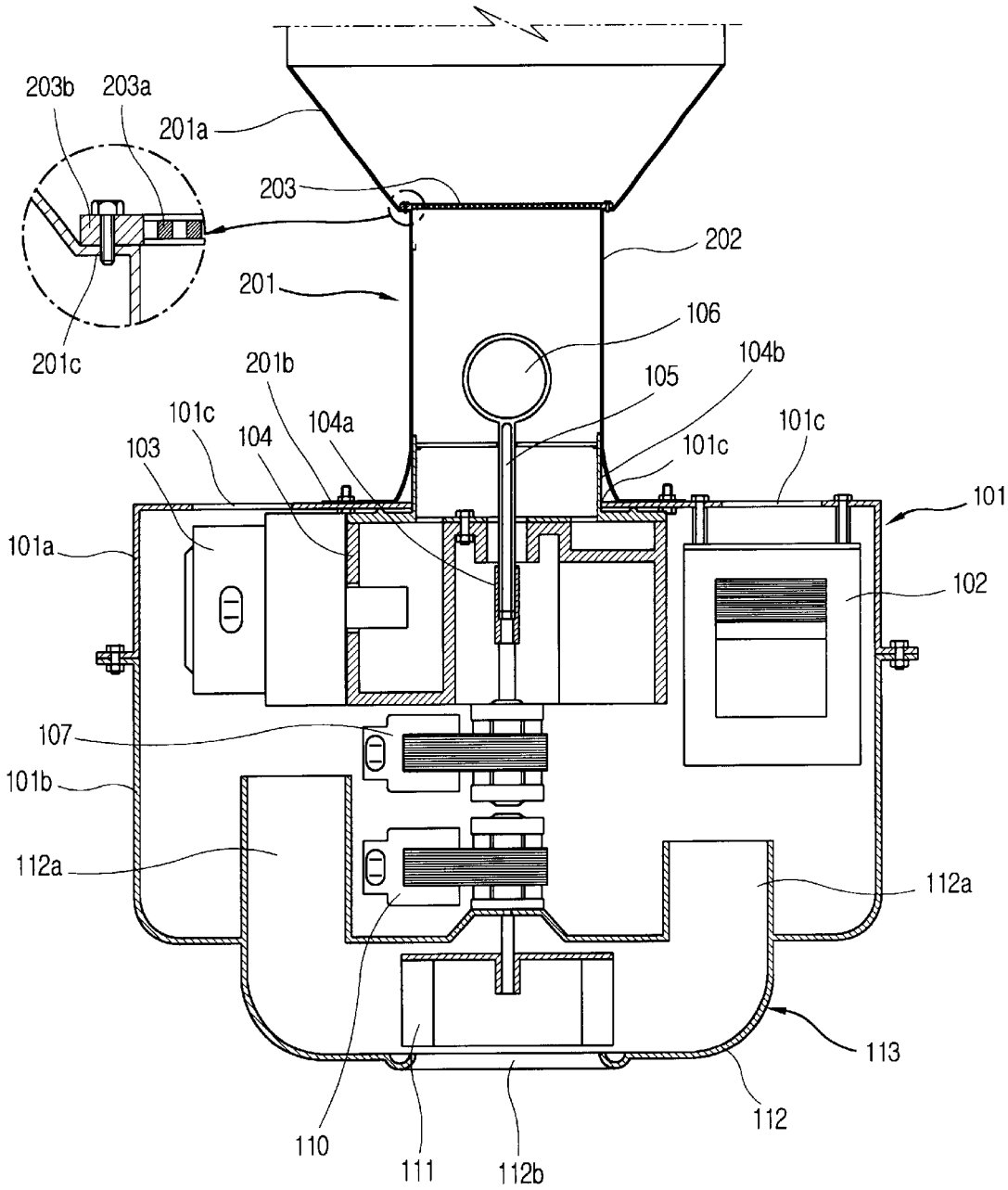
FIG. 4 is a longitudinal cross-sectional view showing an electrodeless lighting system according to another embodiment of the present invention.
Figure 5:
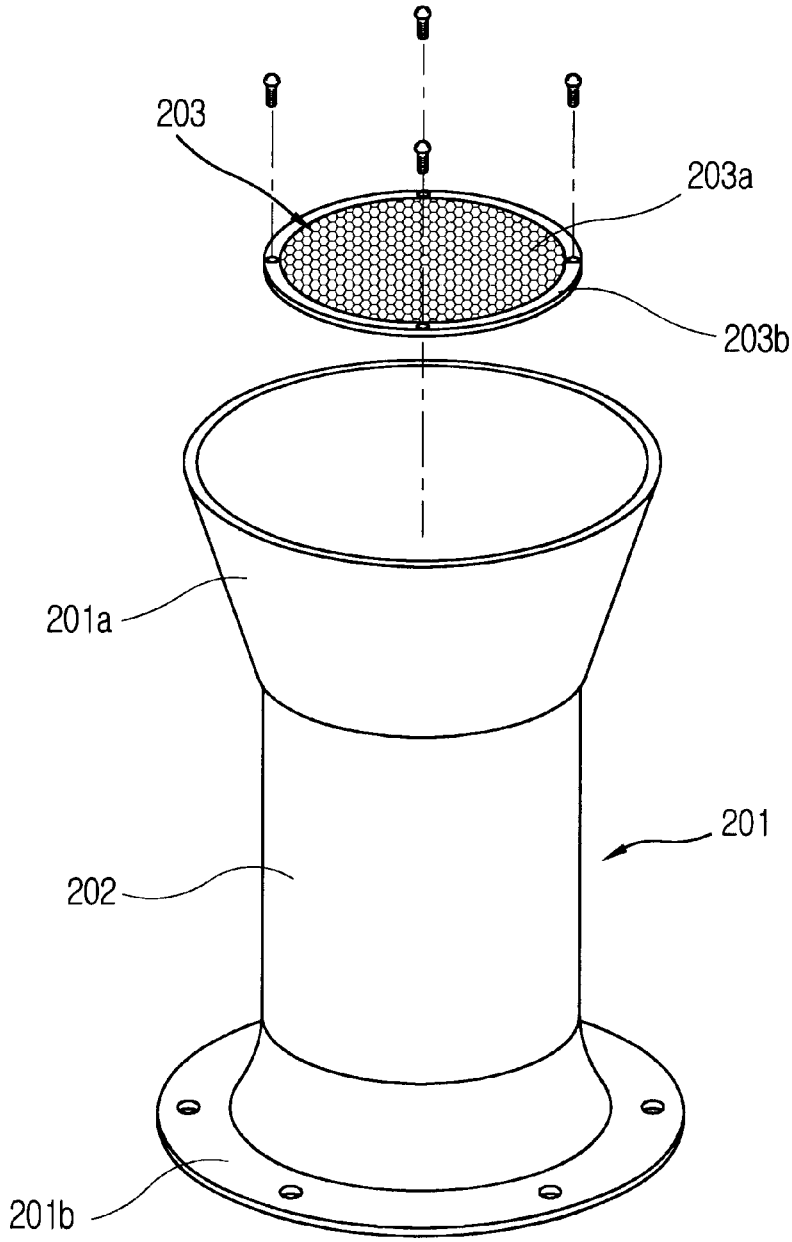
FIG. 5 is a perspective view showing a reflector shown in FIG. 4.

FIG. 4 is a longitudinal cross-sectional view showing an electrodeless lighting system according to another embodiment of the present invention, and FIG. 5 is a perspective view showing a reflector shown in FIG. 4. For same components as those of the above embodiment, same reference numerals are used and detailed descriptions for those are omitted.

A reflector 201 of the electrodeless lighting system according to the another embodiment of the present invention comprises: a fixed portion 201*b* fixed on the case 101 around the exit side of the waveguide 104; a protecting portion 202 extended from the fixed portion 201*b* as cylindrical form for forming a protecting member; and a reflecting portion 201*a* formed as expanded from the protecting portion 201*b* to frontward for reflecting the light generated from the bulb 106 to front side.

Also, a stepped portion 201*c* is installed between the protecting portion 202 and the reflecting portion 201*a* so as to fix a resonator 203.

As shown in FIG. 5, the resonator 203 comprises a reticular portion 203*a* of disc shape, and a fixed portion 203*b* formed as a ring around the reticular portion 203*a* and fixed on the reflector 201, and thereby the leakage of the microwave is prevented and the light emitted from the bulb 106 can be passed.

In the electrodeless lighting system according to the another embodiment of the present invention, when the microwave is outputted to the resonating area made by the resonator 203 and the protecting portion 202 of the reflector 201 through the waveguide 104, the plasma is generated in the bulb 106 to emit the light.

At that time, the light emitted in the bulb 106 is radiated to outer side after passing through the reticular portion 203*a* of the resonator 203, and thereby the space can be lightened.

As described above, according to the electrodeless lighting system of the present invention, the protecting portion is formed around the bulb to prevent the burning of the resonator on reticular portion, and therefore, the leakage of the microwave can be prevented and the stability of operation can be increased.

Also, according to the electrodeless lighting system of the present invention, the protecting portion is formed on the reflector as a single body with the reflector to prevent the damage of the resonating area, at the same time, to prevent the leakage of the microwave, and thereby, the stability can be improved.

Also, the protecting portion is formed on the reflector integrally, and accordingly, the resonator can be formed as a plane plate. Therefore, the fabrication and installation of the resonator can be performed easily and manufacturing cost for the resonator and the lighting system can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system, comprising:

a case;

a waveguide, in which an exit is exposed out of the case, installed in the case for transmitting a microwave generated in a magnetron;

a bulb located outside of the exit of the waveguide and emitting light as generating plasma by the microwave transmitted through the waveguide;

a resonator having a protecting member formed of a non-reticular structure and a reticular member, the protecting member being formed as a cylindrical shape and fixed on the exit of the waveguide so that the walls of the protecting member completely surround the bulb for making a resonating area in which the microwave is resonated, and formed to endure heat generated from the bulb, and the reticular member being formed as a cylindrical shape and connected to the protecting member over the bulb so as to prevent leakage of the microwave and pass the light generated from the bulb.

2. The lighting system of claim 1, wherein the protecting member is made with a material which can block the microwave and the light generated from the bulb.

3. The lighting system of claim 1, wherein the protecting member and the reticular member are formed integrally with each other.

4. The lighting system of claim 3, wherein a portion of the resonator fixed on the exit of the waveguide is opened.

5. A resonator of an electrodeless lighting system comprising:

a protecting portion formed as a cylindrical shape of non-reticular structure fixed on an exit of a waveguide around a bulb for making a resonating area in which a microwave is resonated; and a reticular portion formed as a cylindrical shape and connected to the protecting portion as a single body over the bulb for blocking leakage of the microwave and passing light generated by the bulb.

6. A reflector of an electrodeless lighting system comprising:

a fixed portion attached to a case around an exit of a waveguide;

a protecting portion of non-reticular structure extended from the fixed portion to surround a bulb as a cylindrical form for making a resonating area in which a microwave is resonated; and a reflecting portion expanded from and formed around the protecting portion to reflect light generated from the bulb.

7. A reflector of an electrodeless lighting system comprising:

a protecting portion of a non-reticular structure formed around a bulb as a cylindrical form for making a resonating area in which a microwave is resonated;

a resonator formed in a disc shape on top of the protecting portion and above the bulb; and a reflecting portion expanded upward from the fixed portion to reflect the light emitted from the bulb.

8. The reflector of claim 7, wherein the resonator further comprises:

a reticular portion for blocking leakage of a the microwave; and a fixed portion attached partially on top of the reticular portion so that the fixed portion forms a ring shape around the reticular portion.

9. An electrodeless lighting system, comprising:

a case;

a waveguide, in which an exit is exposed out of the case, installed in the case for transmitting a microwave generated in a magnetron;

a bulb located outside of the exit of the waveguide and emitting light as generating plasma by the microwave transmitted through the waveguide;

a protecting member fixed on the exit of the waveguide so that the walls of the protecting member completely surround the bulb for making a resonating area in which the microwave is resonated, and formed to endure heat generated from the bulb; and a resonator connected to the protecting member over the bulb and having a reticular portion so as to prevent leakage of the microwave and pass the light generated from the bulb; and a reflector installed on the exit side of the waveguide so as to reflect the light generated from the bulb frontward, a part of the reflector forming the protecting member.

10. The lighting system of claim 9, wherein the resonator is fixed on the reflector.

11. The lighting system of claim 9, wherein the resonator is formed as a disc and fixed inside the reflector.

12. The lighting system of claim 11, wherein the resonator includes a reticular portion of disc shape, and a fixed portion formed as a ring around the reticular portion and attached to the reflector.

13. The lighting system of claim 9, wherein the reflector comprises:

a fixed portion fixed and attached to the case around the exit of the wave guide;

a protecting portion extended from the fixed portion as a cylindrical form to form the protecting member; and a reflecting portion formed as expanded frontward from the protecting portion.

14. The lighting system of claim 13, wherein the resonator is fixed between the protecting portion and the reflecting portion.

15. The lighting system of claim 14, wherein the reflector includes a stepped portion between the protecting portion and the reflecting portion so as to fix the resonator.

* * * * *